United States Patent [19]

Wilkes

[11] 4,244,348

[45] Jan. 13, 1981

[54] PROCESS FOR CLEAVING CRYSTALLINE MATERIALS

[75] Inventor: Donald F. Wilkes, Albuquerque, N. Mex.

[73] Assignee: Atlantic Richfield Company, Los Angeles, Calif.

[21] Appl. No.: 74,360

[22] Filed: Sep. 10, 1979

[51] Int. Cl.[3] ..... B28D 1/32

[52] U.S. Cl. ..... 125/23 R; 51/283 R; 225/2

[58] Field of Search ..... 51/283; 125/1, 23 R, 125/23 T; 225/2, 93.5, 96.5, 101

[56] References Cited

U.S. PATENT DOCUMENTS

| | | | |
|---|---|---|---|
| 2,630,174 | 3/1953 | Poteet | 225/101 |
| 3,727,599 | 4/1973 | Sugiki | 125/23 R |
| 3,901,423 | 8/1975 | Hillberry | 225/2 |
| 3,918,216 | 11/1975 | Best | 51/283 |

*Primary Examiner*—Harold D. Whitehead

*Attorney, Agent, or Firm*—Roderick W. MacDonald

[57] ABSTRACT

A process for cleaving boules of single crystal materials such as silicon or germanium into thin wafers. The process comprises creating an inward-directed radial stress concentration completely around a boule which intersects its crystallographic plane of minimum bond strength; and subsequently, triggering the cleavage of a thin wafer from the boule via a shock wave applied normal to its crystallographic plane of minimum bond strength.

7 Claims, 3 Drawing Figures

PROCESS FOR CLEAVING CRYSTALLINE MATERIALS

BACKGROUND OF THE INVENTION

This invention relates to cleaving boules and more particularly to a process for cleaving single crystal materials such as silicon and germanium.

Typically, rods of single crystal material are cut into thin slices or wafers by a saw blade for further processing. These slices are usually on the order of 0.010 to 0.015 inch thick which is about the same thickness as the saw blades utilized. This type of operation for slicing or cleaving to achieve thin wafers results in losses of 50 percent or more of the expensive single crystal material.

U.S. Pat. No. 3,901,423 issued to Hillberry et al provides an improvement over the use of saw blades to slice these single crystal boules into thin wafers. The Hillberry patent provides a method whereby a crystal is fractured in a transverse manner to produce thin wafers. Hillberry et al imparts a desired stress distribution to the crystal which predetermines the direction of crack growth and then initiates the fracture at the desired location. Hillberry et al achieves fracturing by: (1) introducing a preselected stress concentration into the crystal; (2) applying an internal stress acting normally upon the desired fracture plane and (3) applying a sudden acting fracturing force at the desired point of fracture acting substantially perpendicular to the predetermined fracture plane.

The present invention is a process of cleaving a single crystal material (such as silicon or germanium) into thin wafers without the necessity of applying an internal stress which acts normal to the desired fracture plane. The present invention does not require that the fracture initiating force be applied directly at the point of the desired fracture. The process of the present invention does not tear or force the boule apart at a given point but rather applies pressure which allows the boule to cleave at its plane of minimum bond strength, thereby achieving a thin wafer having a smooth surface which does not require further extensive processing to prepare it for its ultimate use, for example, in semiconductors or solar devices.

SUMMARY OF THE INVENTION

It is a primary object of this invention to provide an improved process for cleaving single crystal materials.

It is another object of this invention to provide an improved process for cleaving boules of single crystal material with a minimum amount of pressure.

It is a further object of this invention to provide a wafer cleaving process which yields a smooth wafer surface.

These and other objects are accomplished by a process for cleaving boules of single crystal material such as silicon or germanium into wafers. An inward-directed radial stress concentration is created completely around the boule which intersects the boule's crystallographic plane of minimum bond strength. For silicon and germanium, the plane of minimum bond strength is known to be the 1,1,1 plane. Cleavage of the boule is subsequently triggered with a shock wave applied normal to the crystallographic plane of minimum bond strength whereby a thin wafer is cleaved from the boule. This process provides for material savings of crystalline materials and time savings in creating the thin wafers.

Other objects of this invention will become apparent from the following detailed description.

DESCRIPTION OF THE DRAWINGS

Referring now to FIG. 1, cleavage of the silicon boule 1 into thin wafers is accomplished by creating an inward directed radial stress concentration 360° around boule 1 via constraining a sharp-edged tungsten carbide member 2 against boule 1 with collet 3 along the crystallographic plane of minimum bond strength of boule 1. Cleavage is triggered by striking bushing member 5 with pendulum hammer 6 which imparts an axially induced shock wave to said member 5 which straightens the rotational inertial components of the strike into a linear shock wave. Acoustic lens 4 changes the shock wave from linear to planar for inducing into boule 1. The planar shock wave travels through boule 1 to the position of said member 2 and triggers the cleavage of a thin wafer at that point.

DETAILED DESCRIPTION OF THE INVENTION

Figure 1:
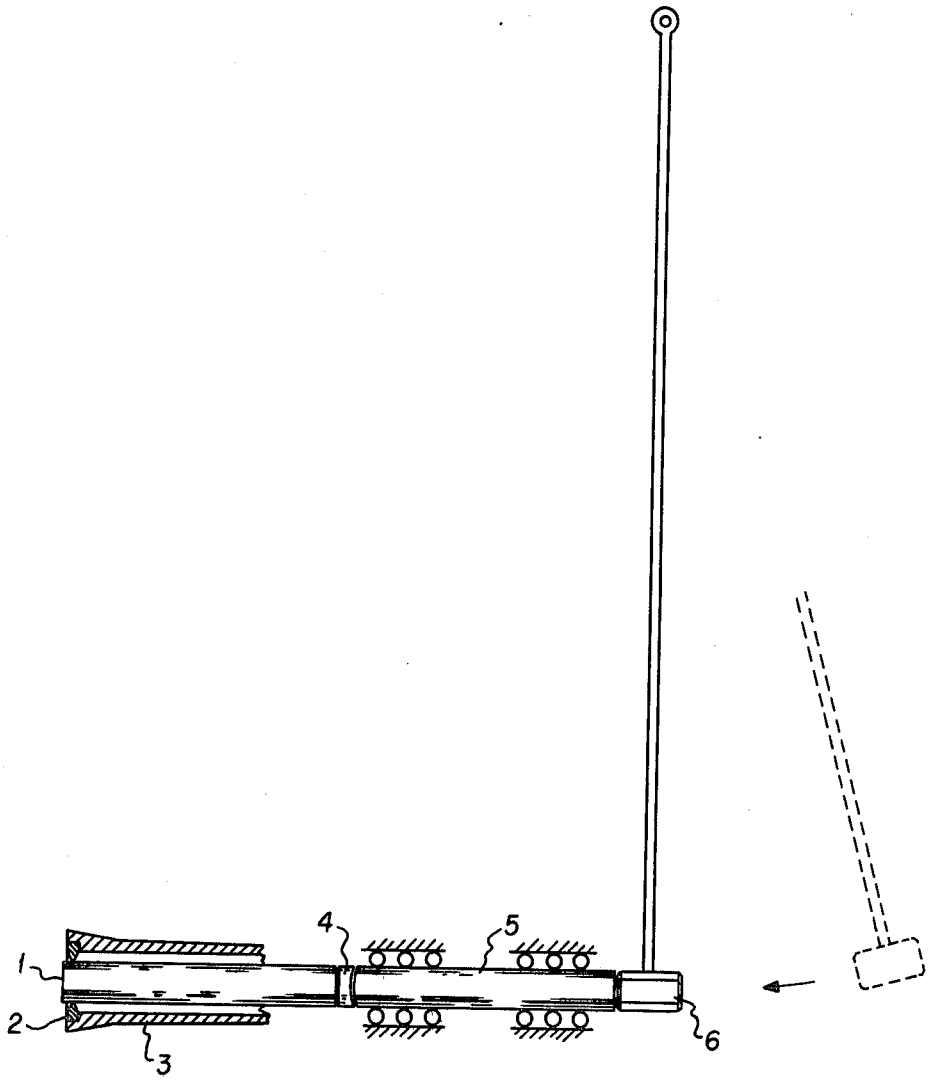
FIG. 1 is a sectional view of an apparatus which can be utilized to perform the process of the invention of the present application.
Figure 2:
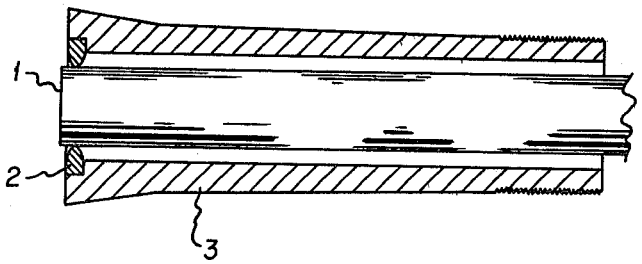
FIG. 2 is an enlarged detail of the apparatus of FIG. 1 showing the collet-constrained member/boule arrangement.
Figure 3:
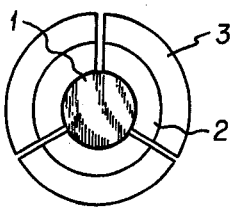
FIG. 3 is an end view of the arrangement of FIG. 2 showing stress concentration 360° around boule 1.

It has been found that the tendency of some crystals to split smoothly is greatly enhanced by creating an inward-directed radial stress concentration 360° around the crystal so as to intersect its crystallographic plane of minimum bond strength. Cleavage of the crystal into smooth segments is then triggered by applying a shock wave normal to the crystallographic plane of minimum bond strength to overcome that bond.

Different cleavage tendencies are exhibited by crystals made of different materials, because of the interrelationship between cleavage tendencies and crystal lattice structure. Various compounds and elements cleave along different crystallographic planes. The system of planes, where cleavage commonly occurs, are known by their Miller indices as the 1,0,0 planes, 1,1,0 planes and the 1,1,1 planes. The individual structure of the crystal and the type of crystal lattice a materal has determines the specific crystallographic plane along which a crystal cleaves.

Previously, it had been thought that to promote cleavage of a crystal, it was very important to apply an external force for cleavage of the crystal along the expected cleavage plane. It was expected that the more precisely the applied force was aligned with the edge of the cleavage plane at the surface of the crystal, the smoother would be the cleavage that took place. In order to further enhance smooth cleavage, it was previously thought that the movement of the instrument with which the force was applied, should be in the line of direction that lay in the cleavage plane so as to trace the plane.

The present invention has no such requirements. The process of the present invention not only increases the tendency of such crystals to split along their crystallographic planes of minimum bond strength, but also reduces the tendency of the crystal to slip and separate along one of its other crystallographic planes. This results in further reduction of waste accompanying the production of single crystal wafers and is an important advantage of the improved process.

In the operation of the present invention, it is very important to provide an inward-directed radial stress concentration uniformly around (360°) the crystal. The uniform stress allows the crystal to cleave only along the crystallographic plane of minimum bond strength upon being triggered by a shock wave applied normal to the plane. Thus, by cleaving along only one plane, the resulting thin wafer is very smooth and free of distortions.

The intensity of the uniformly applied stress should be such that it does not fracture the boule, but provides enough concentrated stress along the boule's crystallographic plane of minimum bond strength that a shock wave applied normal to the plane will trigger the cleavage. The applied stress should be both uniform, that is, evenly distributed around (360°) the boule, and concentrated, that is, focused as a fine line, as much as physically possible at a position which intersects the crystallographic plane of minimum bond strength of the boule. Such stress concentration may be created by a variety of ways including such mechanical means as a collet-constrained member made of high tensile strength material which has an edge sharp enough to impart the required stress concentration. The edge of the member should be as sharp as it can be made without breaking under the pressure of the support provided it. The member may be a thin wire or the like and be made of various materials such as tungsten carbide, alumina ceramics, hardened steel and the like.

In order to trigger the cleavage of a boule which has inward-directed radial stress uniformly imparted to it, it is necessary that a shock wave be applied to the boule normal to its crystallographic plane of minimum bond strength. Such a shock wave should be a wave of high amplitude which moves quickly through the boule. Striking the boule with a high modulus, hard substance, such as a hammer, is one way of providing the necessary shock wave. Striking the boule with such a substance at a velocity that is just short of boule fracturing intensity will yield an axially-induced shock wave which travels through the boule to the position of the stress concentration and triggers the cleavage at that point.

Since the shock wave moves through the boule at the boule material's speed of sound, in actuality it is the leading edge of the shock wave which triggers the cleavage. The striking of the boule which creates the shock wave may be done at a location which is remote from the location of the stress concentrator, such as the center of one end of the boule, and excellent results can be achieved. Preferably, the shock wave imparted to the boule should be created in such a manner that it travels through the boule and all portions of its leading edge reaches the location of stress concentrator at the same time. In other words, the shock wave traveling through the boule in its interior and at its edge should reach the position of the stress concentrator at the same moment to achieve cleavage of a thin planar wafer. The creation of a planar shock wave can provide this desired result. An acoustic lens is one way in which the planar shock wave may be accomplished. The acoustic lens collimates the shock wave imparted to the boule by the striking of same with a high modulus, hard substance.

Depending on the particular apparatus utilized to impart the shock wave to the boule, it may be necessary to utilize an intermediate member to reduce the rotational effects of such apparatus to the boule. In other words, such an intermediate member has the purpose of straightening the rotational inertial components of the strike to the boule into a linear shock wave. Such an intermediate member should be made of a material, such as a bushing type material, which creates an elastic rather than a plastic effect to the shock wave. This intermediate member acts as a momentum transfer stage.

It is to be understood that the foregoing description is merely illustrative of the ways in which the process of the present invention may be carried out. Various other modifications and variations within the scope of the invention will occur to those skilled in the art.

Therefore, I claim:

1. A process for cleaving a thin wafer from a boule of single crystal material comprising the steps of a. creating an inward directed radial stress concentration 360° around said boule, which intersects its crystallographic plane of minimum bond strength, and b. triggering said cleavage of said boule via a shock wave applied normal to said plane whereby said thin wafer is cleaved from said boule.

2. The process of claim 1 wherein said stress concentration is created uniformly.

3. The process of claim 1 wherein said triggering wave is created by striking said boule with a high modulus, hard substance.

4. The process of claim 1 wherein said triggering wave is an axially-induced shock wave.

5. The process of claim 4 wherein said shock wave is planar.

6. The process of claim 1 wherein said crystal material is silicon.

7. The process of claim 1 wherein said crystal material is germanium.

* * * * *